US005605041A

United States Patent [19]

Iwata et al.

[11] Patent Number: 5,605,041

[45] Date of Patent: Feb. 25, 1997

[54] AIR-FUEL RATIO CONTROL SYSTEM FOR INTERNAL COMBUSTION ENGINES

[75] Inventors: Yoichi Iwata; Yoshiharu Ave, both of Wako; Takayoshi Nakayama, Tochigi-ken, all of Japan

[73] Assignee: Honda Giken Kogyo Kabushiki Kaisha, Tokyo, Japan

[21] Appl. No.: 326,391

[22] Filed: Oct. 20, 1994

[30] Foreign Application Priority Data

Oct. 20, 1993 [JP] Japan ..... 5-285886

[51] Int. Cl.[6] ..... F01N 3/28

[52] U.S. Cl. ..... 60/276; 60/285

[58] Field of Search ..... 60/274, 276, 285

[56] References Cited

U.S. PATENT DOCUMENTS 5,127,225 7/1992 Nada ..... 60/285

FOREIGN PATENT DOCUMENTS 63-195351 8/1988 Japan .

*Primary Examiner*—Douglas Hart

*Attorney, Agent, or Firm*—Nikaido, Marmelstein, Murray & Oram LLP

[57] ABSTRACT

An air-fuel ratio control system for an internal combustion engine comprises upstream and downstream O2 sensors arranged in the exhaust system of the engine at respective locations upstream and downstream of a catalytic converter, for detecting concentration of oxygen in exhaust gases from the engine. An ECU sets a control variable having a value proportional to the difference between an output from the downstream O2 sensor and a first predetermined reference value, and compares between an output from the upstream O2 sensor and a second predetermined reference value, to thereby calculate an air-fuel ratio correction coefficient, based on results of comparison and the set control variable. The air-fuel ratio of an air-fuel mixture supplied to the engine is controlled based on the calculated air-fuel ratio correction coefficient.

8 Claims, 9 Drawing Sheets

KO2 CALCULATION
INITIALIZE FAF1 & FAF2
S201
INITIALIZE KO2
S202
S203
KO2 INITIALIZED IN PRESENT LOOP ?
YES
NO
S204
VO2F<FVREF ?
NO
YES
S205
S208
FAF1←0
CDLY1←CDLY1−1
FAF1←1
CDLY1←CDLY1+1
S206
S209
CDLY1<TDR1 ?
NO
CDLY1<TDL1 ?
YES
S207
S210
YES
NO
CDLY1←TDR1
CDLY1←TDL1
S211
CDLY1 INVERTED?
NO
YES
A
B

A
B
S222
FAF1=0?
YES
NO
S223
FAF2←0
S224
CDLY1←TDR1
S225
KO2←KO2 +(PR×KP)
S226
EXECUTE LIMIT CHECKING OF KO2
S227
CALCULATE KREF0 & KREF1
S218
EXECUTE LIMIT CHECKING OF KREF
RETURN
S228
FAF2←1
S229
CDLY1←TDL1
S230
KO2←KO2 −(PL×KP)
S212
FAF2=0?
S213
FAF1=0?
S214
CDLY1←TDR1
S215
KO2←KO2+I
S216
EXECUTE LIMIT CHECKING OF KO2
S217
CALCULATE KREF2
S219
FAF1=1?
S220
CDLY1←TDL1
S221
KO2←KO2−I

C
D
E
F
S359
PL←PL−DPL
S360
PL<PLMIN?
YES
NO
S361
PL←PLMIN
S366
PL←PL+DPR
S367
PL>PLMAX?
S368
PL←PLMAX
S373
PL←PL−DPLS
S374
PL<PLMIN?
S375
PL←PLMIN
S379
PL←PL+DPRS
S380
PL>PLMAX?
S381
PL←PLMAX
S382
RETRIEVE ΔPR & ΔPL ACCORDING TO VO2R
S383
PR=PR+ΔPR
PL=PL+ΔPL
S384
CALCULATE PREF
S385
EXECUTE PREF LIMIT CHECKING
G
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system which controls the air-fuel ratio of an air-fuel mixture supplied to the engine, based on outputs from upstream air-fuel ratio-detecting means and downstream air-fuel ratio-detecting means arranged in the exhaust system at respective locations upstream and downstream of a catalytic converter in the exhaust system of the invention.

2. Prior Art

There has been conventionally known an air-fuel ratio control system for internal combustion engines, for example, from Japanese Provisional Patent Publication (Kokai) No. 63-195351, in which a so-called double O2 sensor system is employed. According to the proposed air-fuel ratio control system, in controlling the air-fuel ratio of a mixture supplied to the engine to a desired value in a feedback manner responsive to an output from an upstream O2 sensor as air-fuel ratio-detecting means arranged in the exhaust system at a location upstream of a catalyst in the exhaust system, when the output from the upstream O2 sensor is inverted with respect to a predetermined value, a skip amount (proportional term) is added to or subtracted from an air-fuel ratio correction coefficient. The skip amount to be added or subtracted is changed based on an output from a downstream O2 sensor as air-fuel ratio-detecting means arranged downstream of the catalyst. Further, a calculation is made of the difference between the output from the downstream O2 sensor and a predetermined reference value corresponding to a stoichiometric air-fuel ratio, and an amount of change per unit time for updating the skip amount is increased as the calculated difference is larger.

However, the above proposed air-fuel ratio control system only executes integral control by progressively decreasing or increasing the skip amount after the output VO2R from the downstream O2 sensor has crossed the predetermined reference value. As a result, a responsive lag occurs in the air-fuel ratio feedback control based on the output VO2R from the downstream O2 sensor. FIG. 1 shows the relationship timing between the air-fuel ratio A/F of a mixture supplied to the engine, which is calculated by the conventional feedback control system, and the output VO2R from the downstream O2 sensor. As shown in FIG. 1, although an average value of the air-fuel ratio A/F of the mixture, i.e. the air-fuel ratio downstream of the catalyst sensed by the downstream O2 sensor should show a value in the vicinity of the stoichiometric value at a time point immediately before an inversion of the output VO2R from the downstream O2 sensor (regions i and j), there unfavorably occurs an over-lean state (region i) or an over-rich state (region j) of the mixture supplied to the engine due to the response lag of the feedback control, since the skip amount (proportional term) to be added to or subtracted from the air-fuel ratio correction coefficient KO2 is only integral-controlled, which results in unfavorably degraded exhaust emission characteristics of the engine.

SUMMARY OF THE INVENTION

It is the object of the invention to provide an air-fuel ratio control system for internal combustion engines, which is capable of accurately controlling the air-fuel ratio of a mixture supplied to the engine in a feedback manner by improving the responsiveness of a control variable which is determined based on an output from downstream air-fuel ratio-detecting means arranged downstream of a catalytic converter in the exhaust system of the engine, to thereby prevent degraded exhaust emission characteristics of the engine.

To attain the above object, the present invention provides an air-fuel ratio control system for an internal combustion engine having an exhaust system, and a catalytic converter arranged in the exhaust system, for purifying noxious components in exhaust gases emitted from the engine, comprising:

upstream air-fuel ratio-detecting means arranged in the exhaust system at a location upstream of the catalytic converter, for detecting concentration of a specific component of the exhaust gases;

downstream air-fuel ratio-detecting means arranged in the exhaust system at a location downstream of the catalytic converter, for detecting concentration of the specific component of the exhaust gases;

control variable-setting means for setting a control variable having a value proportional to a difference between an output from the downstream air-fuel ratio-detecting means and a first predetermined reference value;

air-fuel ratio correction value-calculating means for comparing between an output from the upstream air-fuel ratio-detecting means and a second predetermined reference value, and calculating an air-fuel ratio correction value, based on results of the comparison and the control variable set by the control variable-setting means; and air-fuel ratio control means for controlling an air-fuel ratio of an air-fuel mixture supplied to the engine, based on the air-fuel ratio correction value calculated by the air-fuel ratio correction value-calculating means.

Preferably, the control variable determines a proportional term which is added to or subtracted from the air-fuel ratio correction value in response to an inversion of the output from the upstream air-fuel ratio-detecting means with respect to the second predetermined reference value.

More preferably, the control variable-setting means sets the control variable such that the air-fuel ratio correction value is changed by a larger value as the difference between the output from the downstream air-fuel ratio-detecting means and the first predetermined reference value is larger.

Also preferably, the control variable is added to or subtracted from the proportional term.

Advantageously, the proportional term is determined based on integral control responsive to the output from the downstream air-fuel ratio-detecting means.

A preferred embodiment of the invention provides an air-fuel ratio control system for an internal combustion engine having an exhaust system, and a catalytic converter arranged in the exhaust system, for purifying noxious components in exhaust gases emitted from the engine, comprising:

upstream air-fuel ratio-detecting means arranged in the exhaust system at a location upstream of the catalytic converter, for detecting concentration of a specific component of the exhaust gases;

downstream air-fuel ratio-detecting means arranged in the exhaust system at a location downstream of the catalytic converter, for detecting concentration of the specific component of the exhaust gases;

control variable-setting means for setting a first control variable and a second control variable having values both proportional to a difference between an output from the downstream air-fuel ratio-detecting means and a first predetermined reference value;

air-fuel ratio correction value-calculating means for comparing between an output from the upstream air-fuel ratio-detecting means and a second predetermined reference value, and calculating an air-fuel ratio correction value, based on results of the comparison and the first and second control variables set by the control variable-setting means; and air-fuel ratio control means for controlling an air-fuel ratio of an air-fuel mixture supplied to the engine, based on the air-fuel ratio correction value calculated by the air-fuel ratio correction value-calculating means;

wherein the first control variable determines a first proportional term which is added to from the air-fuel ratio correction value in response to the inversion of the output from the upstream air-fuel ratio-detecting means from a rich side to a lean side with respect to the second predetermined reference value, and the second control variable determines a second proportional term which is subtracted from the air-fuel ratio correction value in response to the inversion of the output from the upstream air-fuel ratio-detecting means from the lean side to the rich side with respect to the second predetermined reference value.

Preferably, the control variable-setting means sets the first and second control variables such that the air-fuel ratio correction value is changed by a larger value as the difference between the output from the downstream air-fuel ratio-detecting means and the second predetermined reference value is larger.

Advantageously, the first and second proportional terms are determined based on integral control responsive to the output from the downstream air-fuel ratio-detecting means.

The above and other objects, features, and advantages of the invention will be more apparent from the following detailed description taken in conjunction with the accompanying drawings.

DETAILED DESCRIPTION

The invention will now be described in detail with reference to drawings showing an embodiment thereof.

Figure 1:
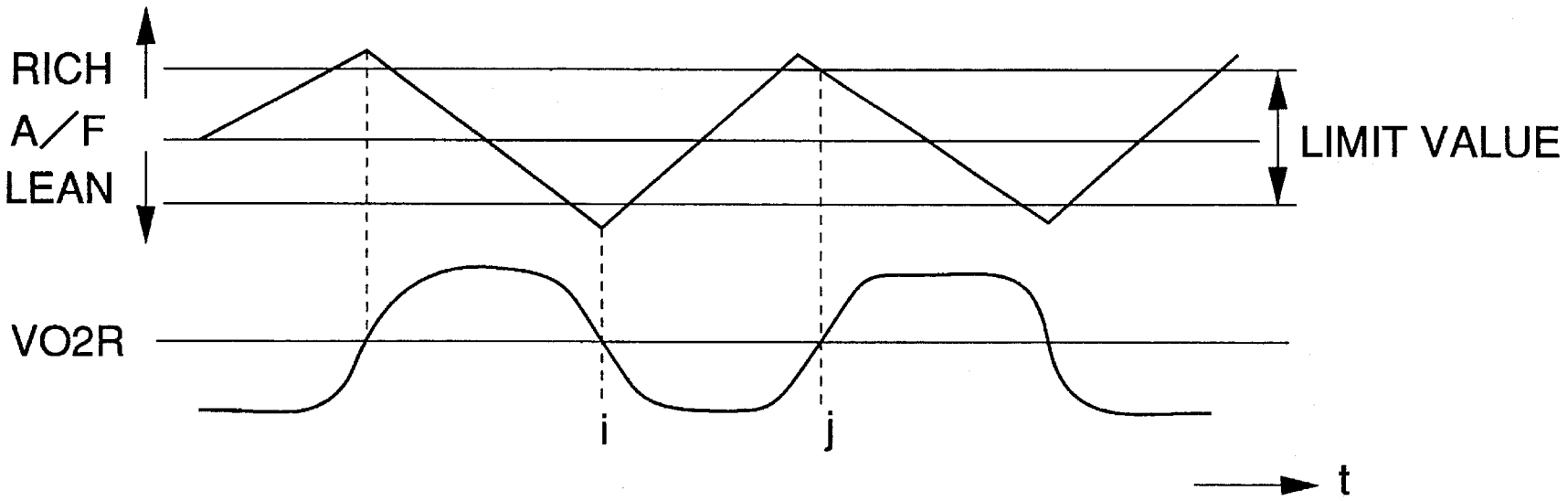
FIG.1 PRIOR ART
FIG. 1 is a timing chart showing the relationship in timing between the air-fuel ratio A/F of a mixture supplied to an internal combustion engine calculated by feedback control according to a conventional air-fuel ratio control system, and the output VO2R from the downstream O2 sensor.
Figure 2:
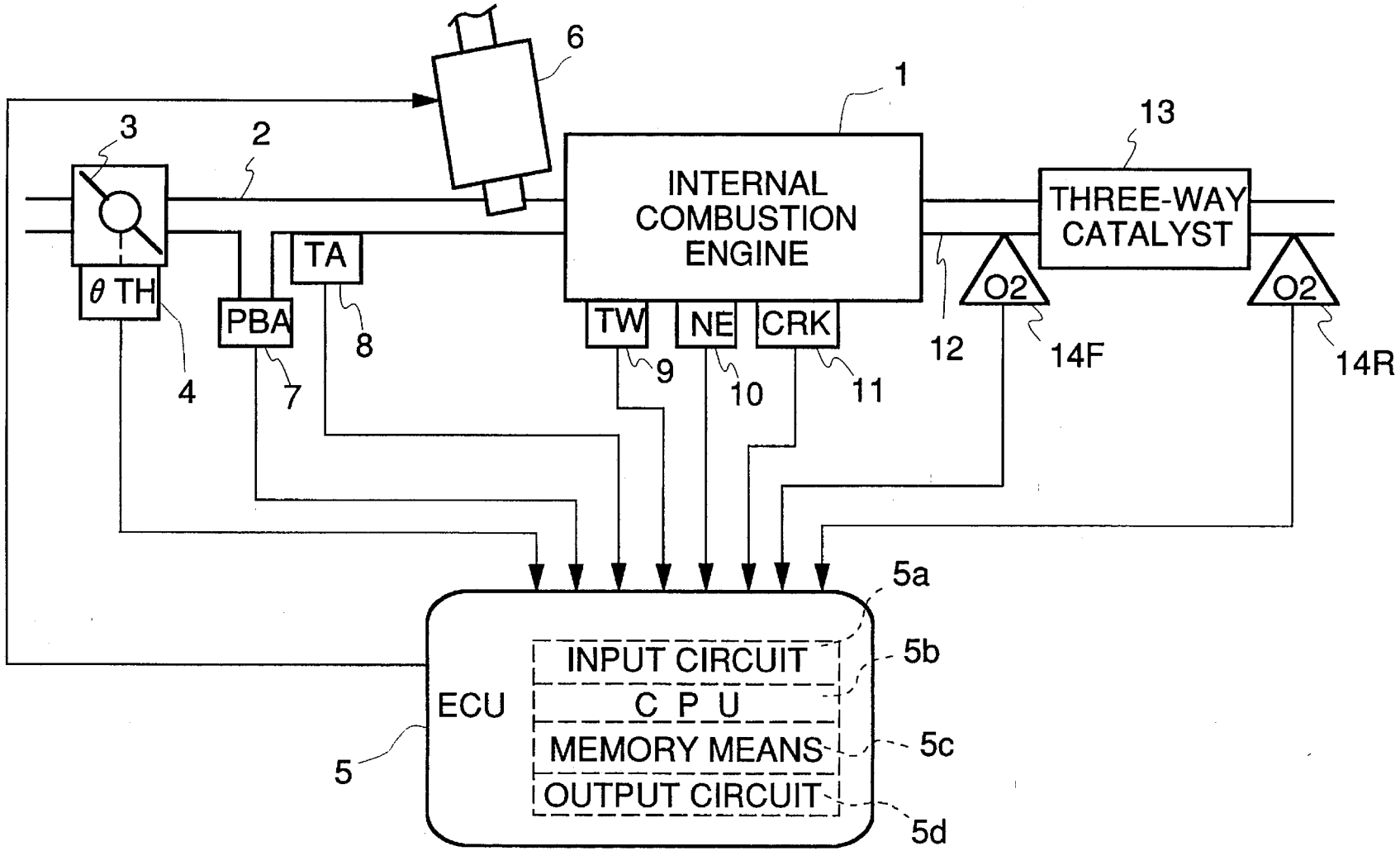
FIG. 2 is a schematic diagram showing the whole arrangement of an internal combustion engine and an air-fuel ratio control system therefor, according to an embodiment of the invention.

Referring first to FIG. 2, there is schematically shown the whole arrangement of an internal combustion engine and an air-fuel ratio control system therefor, according to an embodiment of the invention. In the figure, reference numeral 1 designates an internal combustion engine (hereinafter referred to as "the engine") having e.g. four cylinders. In an intake pipe 2 of the engine 1, there is arranged a throttle valve 3, to which is connected a throttle valve opening (θTH) sensor 4 for sensing the valve opening of the throttle valve 3 and supplying an electric signal indicative of the sensed throttle valve opening to an electronic control unit (hereinafter referred to as "the ECU") 5.

Fuel injection valves 6, only one of which is shown, are each provided for each cylinder and arranged in the intake pipe 2 between the engine 1 and the throttle valve 3 at a location slightly upstream of an intake valve, not shown. Each fuel injection valve 6 is connected to a fuel pump, not shown, and electrically connected to the ECU 5 to have its valve opening period controlled by a signal therefrom.

On the other hand, an intake pipe absolute pressure (PBA) sensor 7 is provided in communication with the interior of the intake pipe 2 at a location immediately downstream of the throttle valve 3 for sensing absolute pressure (PBA) within the intake pipe 2, and is electrically connected to the ECU 5 for supplying an electric signal indicative of the sensed absolute pressure PBA to the ECU 5. Further, arranged at a location downstream of the absolute pressure (PBA) sensor 7 is an intake air temperature (TA) sensor 8 which is inserted into the intake pipe 2 for supplying an electric signal indicative of the sensed intake air temperature TA to the ECU 5.

An engine coolant temperature (TW) sensor 9, which may be formed of a thermistor or the like, is mounted in a coolant-filled cylinder block of the engine for supplying an electric signal indicative of the sensed engine coolant temperature TW to the ECU 5. An engine rotational speed (NE) sensor 10 and a CRK sensor 11 are arranged in facing relation to a camshaft or a crankshaft of the engine 1, neither of which is shown. The NE sensor 10 generates a pulse as a TDC signal pulse at each of predetermined crank angles whenever the crankshaft rotates through 180 degrees, while the CRK sensor 11 generates a pulse (hereinafter referred to as "the CRK signal pulse" at one of predetermined crank angles of the engine whenever the crankshaft rotates, e.g. through 30 degrees, both of the pulses being supplied to the ECU 5.

A catalyst (three-way catalyst as a catalytic converter: hereinafter referred to as "the catalyst") 13 is arranged in an exhaust pipe 12 connected to the engine 1. An upstream O2 sensor 14F as upstream air-fuel ratio-detecting means and a downstream O2 sensor 14R as downstream air-fuel ratio-detecting means are arranged in the exhaust pipe 12 at respective locations upstream and downstream of the catalyst 13 for detecting the concentration of oxygen present in exhaust gases at their respective locations and supplying electric signals VO2F and VO2R indicative of the sensed oxygen concentration to the ECU 5.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* including a ROM storing various operational programs which are executed by the CPU 5*b*, and various maps and tables including ones referred to hereinafter, and a RAM for storing results of calculations therefrom, etc., and an output circuit 5*d* which delivers driving signals to the fuel injection valves 6.

The CPU 5*b* operates in response to the above-mentioned signals from the sensors to determine operating conditions in which the engine 1 is operating, such as an air-fuel ratio feedback control region and open-loop control regions, and calculates, based upon the determined engine operating conditions, the valve opening period or fuel injection period TOUT over which the fuel injection valves 6 are to be opened, by the use of the following equation (1), in synchronism with generation of TDC signal pulses:

$$TOUT=Ti\times KO2\times K_1+K_2 \quad (1)$$

where Ti represents a basic value of the fuel injection period TOUT, which is determined according to the engine rotational speed NE and the intake pipe absolute pressure PBA. KO2 represents an air-fuel ratio correction coefficient which is determined based on outputs from the upstream and downstream O2 sensors 14F and 14R, by a feedback control program, described hereinafter, when the engine 1 is operating in the air-fuel ratio feedback control region, while it is set to predetermined values corresponding to the respective open-loop control regions of the engine when the engine 1 is in the open-loop control regions.

K1 and K2 represent other correction coefficients and correction variables, respectively, which are set according to engine operating parameters to such values as optimize operating characteristics of the engine, such as fuel consumption and engine accelerability.

The CPU 5*b* supplies driving signals via the output circuit 5*d* to the fuel injection valves 6, based on the fuel injection period TOUT thus determined, to drive the fuel injection valves 6.

[Air-fuel ratio feedback control]

Next, description will be made of details of the air-fuel ratio feedback control based on the outputs from the upstream and downstream O2 sensors 14F and 14R (hereinafter referred to as "the 2-O2 F/B control").

Figure 3A:
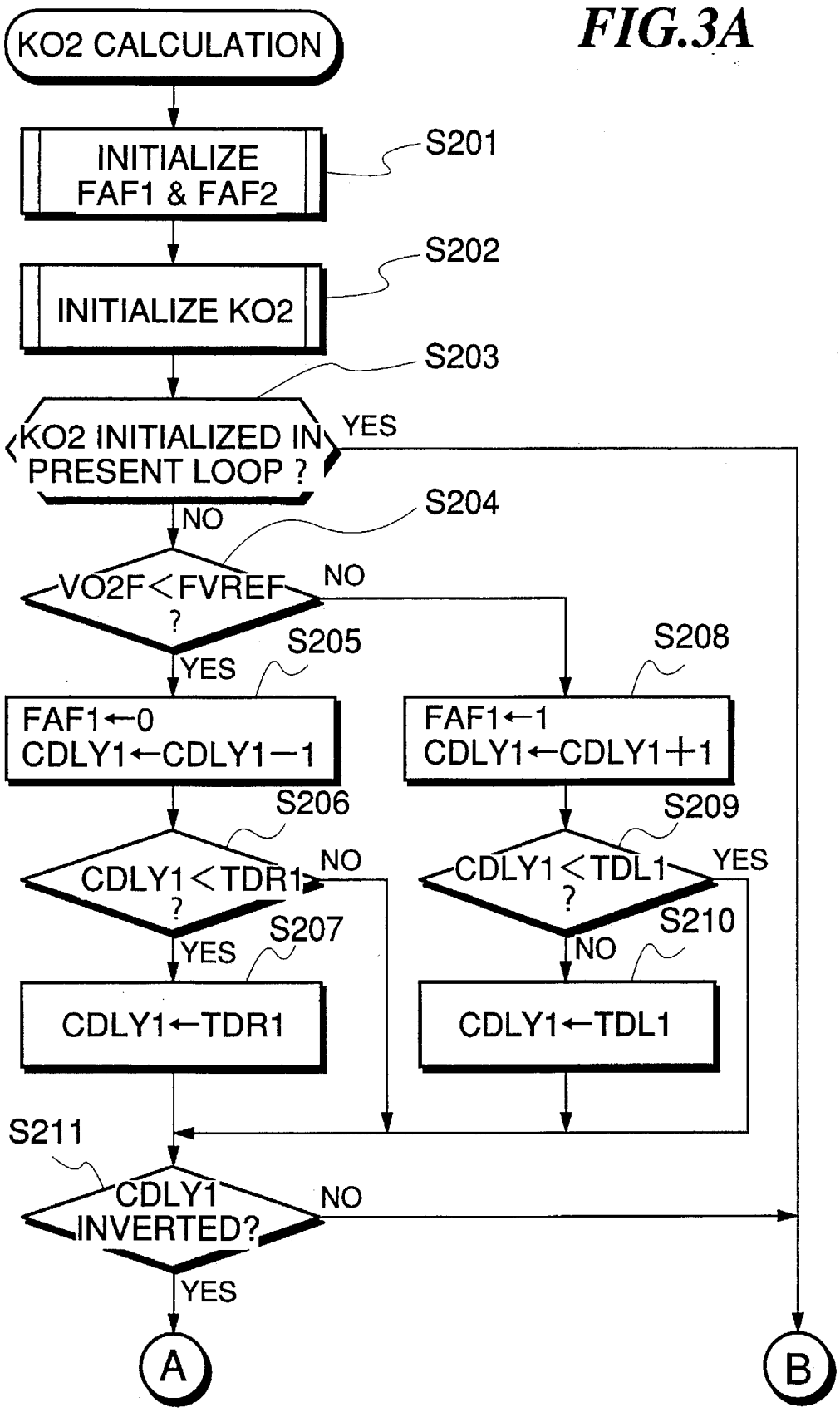
FIG. 3A is a flowchart showing a program for calculating an air-fuel ratio correction coefficient KO2 applied in air-fuel ratio feedback control carried out by the use of two O2 sensors.
Figure 3B:
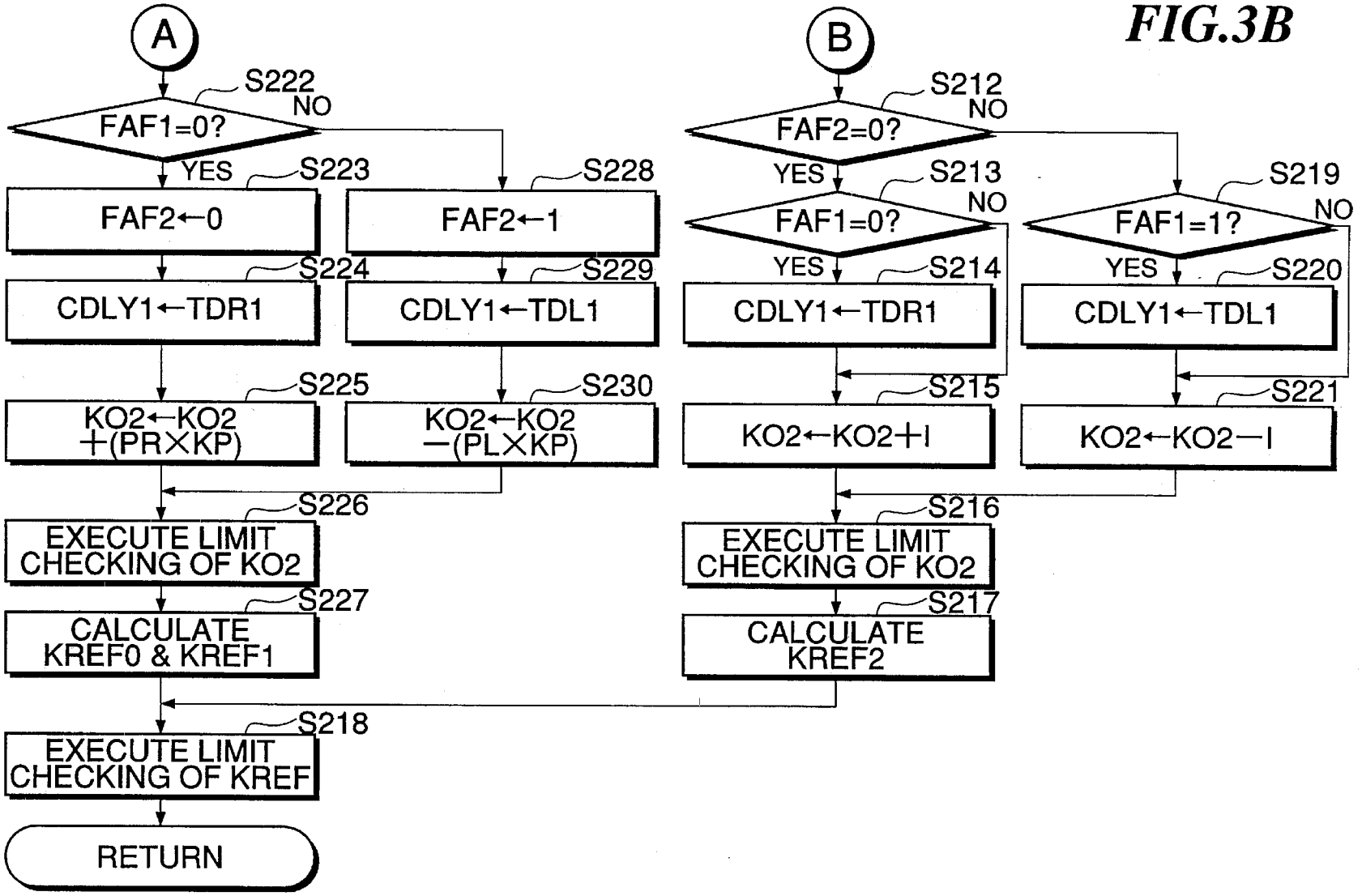
FIG. 3B is a continued part of the FIG. 2A flowchart.

FIGS. 3A and 3B show a program for calculating the air-fuel ratio correction coefficient KO2 applied during the 2-O2 sensor F/B control. In this program, the air-fuel ratio correction coefficient KO2 is calculated based on the output VO2F from the upstream O2 sensor 14F and the output VO2R from the downstream O2 sensor 14R, such that the air-fuel ratio of an air-fuel mixture supplied to the engine becomes equal to a stoichiometric value ($\lambda$=1).

First, at a step S201, flags FAF1 and FAF2 are initialized. The flag FAF1, when set to "0" and "1", indicates lean and rich states of the output VO2F from the upstream O2 sensor 14F, respectively, and the flag FAF2, when set to "0" and "1", indicates lean and rich states of the output VO2F, respectively, after the lapse of a predetermined delay time has been counted up by a counter CDLY1, referred to hereinafter. Then, at a step S202, the air-fuel ratio correction coefficient KO2 is initialized (e.g. set to an average value KREF thereof), followed by the program proceeding to a step S203. The steps S201 and S202 are carried out only once when the KO2-calculating program is started.

At the step S203, it is determined whether or not the air-fuel ratio correction coefficient KO2 has just been initialized in the present loop. If the answer is negative (NO), the program proceeds to a step S204, wherein it is determined whether or not the upstream O2 sensor output VO2F is lower than a reference value FVREF (threshold value for determining whether the output VO2F is lean or rich). If the answer is affirmative (YES), i.e. if VO2F<FVREF, it is determined that the output VO2F indicates a lean value, and then the flag FAF1 is set to "0" at a step S205, and at the same time the count value CDLY1 of the counter CDLY for counting the P term-adding/subtracting delay time is decremented by a value of 1. Then, at a step S206, it is determined whether or not the count value CDLY1 is smaller than a delay time value TDR1. If the answer is affirmative (YES), i.e. if CDLY1<TDR1, the count value CDLY1 is set to the delay time value TDR1 at a step S207.

On the other hand, if the answer to the question of the step S204 is negative (NO), i.e. if VO2F≧FVREF, which means that the output VO2F indicates a rich value, the flag FAF1 is set to "1" and at the same time the count value CDLY1 is incremented by a value of 1 at a step S208. Then, at a step S209, it is determined whether or not the count value CDLY1 is smaller than a delay time value TDL1. If the answer is negative (NO), i.e. if CDLY1≧TDL1, the count value CDLY1 is set to the delay time value TDL1 at a step S210.

If the answer to the question of the step S206 is negative (NO), i.e. if CDLY1≧TDR1, the program skips over the step S207 to a step S211. Similarly, if the answer to the question of the step S209 is affirmative (YES), i.e. if CDLY1 <TDL1, the program skips over the step S210 to the step S211.

At the step S211, it is determined whether or not the sign of the count value CDLY1 has been inverted. That is, it is determined whether or not the delay time value TDR1 or TDL1 has been counted up after the output VO2F from the upstream O2 sensor 14F crossed the reference value FVREF. Actually, the delay time values TDR1 and TDL1 are negative and positive count values, respectively, and hence it is determined here whether or not a delay time period corresponding to the absolute value of the delay time value TDR1 or that of the delay time values TDL1 has elapsed after the output VO2F crossed the reference value FVREF. If the answer to this question is negative (NO), i.e. if the delay time period TDR1 or TDL1 has not elapsed, the program proceeds to a step S212, wherein it is determined whether or not the flag FAF2 has been set to "0". If the answer is affirmative (YES), it is determined at a step S213 whether or not the flag FAF1 has been set to "0". If the answer is affirmative (YES), it is judged that the air-fuel ratio has continuously been lean, so that the program proceeds to a step S214, wherein the count value CDLY1 is set to the delay time value TDR1, followed by the program proceeding to a step S215. If the answer to the question of the step S213 is negative (NO), it is judged that the delay time has not elapsed yet after the output VO2F from the upstream O2 sensor 14F was inverted from a lean side to a rich side, i.e. after it crossed the reference value FVREF, so that the program skips over the step S214 to the step S215.

At the step S215, a present value of the air-fuel ratio correction coefficient KO2 is obtained by adding an integral term I to a value of the coefficient KO2 calculated in the immediately preceding loop by the use of the following equation (2):

$$KO2=KO2+I \quad (2)$$

After execution of the step S215, limit-checking of the resulting value of the correction coefficient KO2 is carried out by a known method at a step S216. Then, a calculation is made of a value KREF2 (learned value of the correction coefficient KO2 used in starting the vehicle) at a step S217, and limit-checking of the resulting value KREF2 is carried out at a step S218, followed by terminating the program.

On the other hand, if the answer to the question of the step S212 is negative (NO), i.e. if the flag FAF2 has been set to "1", it is further determined at a step S219 whether or not the flag FAF1 has been set to "1". If the answer is affirmative (YES), it is judged that the air-fuel ratio has continuously been rich, and then at a step S220, the count value CDLY1 is set to the delay time value TDL1 again, followed by the program proceeding to a step S221. On the other hand, if the answer to the question of the step S219 is negative (NO), it is judged that the delay time period has not elapsed yet after the output VO2F from the upstream O2 sensor 14F was inverted from the rich side to the lean side, so that the program skips over the step S220 to the step S221. At the step S221, a present value of the correction coefficient KO2 is calculated by subtracting the integral term I from the immediately preceding value of the correction coefficient KO2 by the use of the equation (3):

$$KO2=KO2 \quad (3)$$

Then, the above steps S216 to S218 are carried out, followed by terminating the routine.

Thus, when the sign of the count value CDLY1 of the counter CDLY has not been inverted, the statuses of the flags FAF1 and FAF2 are checked to determine whether the output VO2F from the upstream O2 sensor 14F has been inverted from the lean side to the rich side or vice versa. The correction coefficient KO2 is calculated based on the result of the determination.

On the other hand, if the answer to the question of the step S211 is affirmative (YES), i.e. if the sign of the count value CDLY1 has been inverted, that is, if a time period corresponding to the absolute value of the delay time value TDR1 or the delay time value TDL1 has elapsed after the output VO2F from the upstream O2 sensor 14F was inverted from the lean side to the rich side or vice versa, the program proceeds to a step S222, wherein it is determined whether or not the flag FAF1 has been set to "0", i.e. whether or not the output VO2F from the upstream O2 sensor 14F indicates a lean value. If the answer to the question of the step S222 is affirmative (YES), i.e. if FAF1=0 (the output VO2F indicates a lean value), the program proceeds to a step S223, wherein the flag FAF2 is set to "0", and then at a step S224, the count value CDLY1 is set to the delay time value TDR1, followed by the program proceeding to a step S225.

At the step S225, a present value of the correction coefficient KO2 is calculated by adding the product of a proportional term PR and a coefficient KP to the immediately preceding value of the correction coefficient KO2 by the use of the following equation (4):

$$KO2=KO2+(PR\times KP) \quad (4)$$

where KO2 on the right side represents the immediately preceding value of the correction coefficient KO2, and the proportional term PR a correction term employed for shifting the air-fuel ratio toward the rich side by increasing the correction coefficient KO2 in a stepwise manner when the time period corresponding to the delay time value TDL1 has elapsed after the output VO2F from the upstream O2 sensor 14F was inverted from the rich side to the lean side with respect to the stoichiometric value. The proportional term PR is varied according to the output VO2R from the downstream O2 sensor 14R (the manner of calculation of PR will be described hereinafter). Further, the coefficient KP is set at a step S252 or S253, referred to hereinbelow, depending on operating conditions of the engine.

Then, limit-checking of the correction coefficient KO2 is carried out at a step S226, and a value KREF0 (average value of the correction coefficient KO2 calculated when the engine is idling) and a value KREF1 (average value of the correction coefficient KO2 calculated when the engine is not idling) are calculated at a step S227. Then, the program proceeds to the step S218, followed by terminating the program.

If the answer to the question of the step S222 is negative (NO), i.e. if the output VO2F from the upstream O2 sensor 14F indicates a rich value (FAF1=1), the program proceeds to a step S228, wherein the flag FAF2 is set to "1", and then at a step S229, the count value CDLY1 is set to the delay time value TDL1, followed by the program proceeding to a step S230.

At the step S230, a present value of the correction coefficient KO2 is calculated by subtracting the product of the proportional term PL and the coefficient KP from the immediately preceding value of the correction coefficient KO2 by the use of the following equation (5):

$$KO2=KO2-(PL\times KP) \quad (5)$$

where KO2 on the right side represents the immediately preceding value of the correction coefficient KO2, and the proportional term PL a correction term employed for shifting the air-fuel ratio toward the lean side by decreasing the correction coefficient KO2 in a stepwise manner when the delay time value TDR1 has elapsed after the output VO2F from the upstream O2 sensor 14F was inverted from the lean side to the rich side with respect to the stoichiometric value. The proportional term PL is varied according to the output VO2R from the downstream O2 sensor 14R (the manner of calculation of PL will be described hereinafter).

Then, the steps S226, S227 and S218 are sequentially carried out, followed by terminating the program. Thus, the timing of generation of the integral term I and the proportional term PR or PL of the correction coefficient KO2 is determined based on the output VO2F from the upstream O2 sensor 14F.

Figure 4:
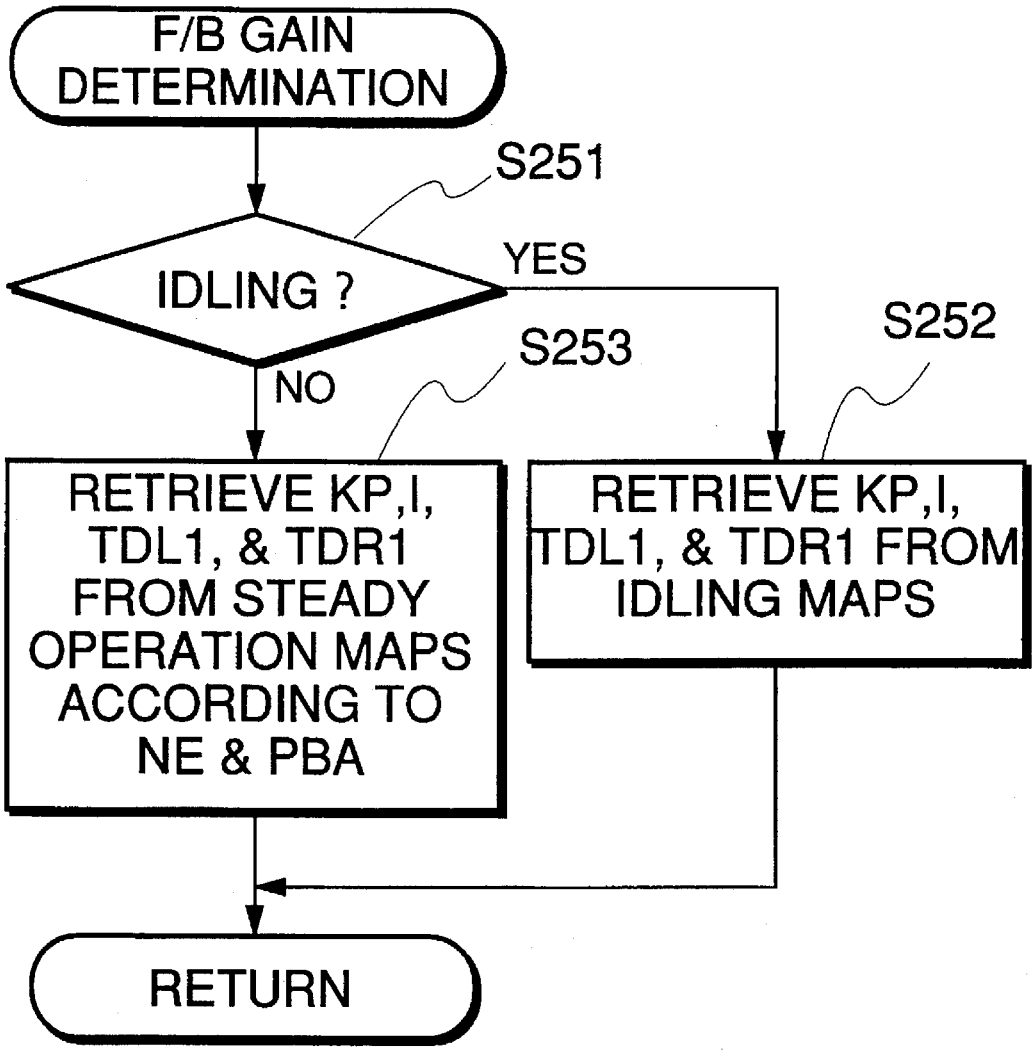
FIG. 4 is a flowchart showing a program for retrieving feedback gain-determining parameters to be applied in the air-fuel ratio feedback control based on an output from an upstream O2 sensor 14F.

The integral term I, the coefficient KP, etc. as feedback gain-determining parameters are set based on appropriate maps, according to the following program: FIG. 4 shows a program for retrieving values of the feedback gain-determining parameters used in the 2-O2 sensor F/B control responsive to the output from the upstream O2 sensor 14F. Basically, the feedback gain is suitably determined based on the engine rotational speed NE and the intake pipe absolute pressure PBA.

First, at a step S251, it is determined whether or not the engine is in an idling condition. If it is determined that the engine is idling, the coefficient KP (P (proportional) term adding/subtracting coefficient), the coefficient KP, the integral term (I term) I, and the delay time value TDL1 (P term-adding delay time) and the delay time value TDR1 (P term-subtracting delay time), which are to be applied when the engine is idling, are read from respective maps for idling at the step S252, followed by terminating the program. If it is determined that the engine is not idling, i.e. if the engine operating condition is steady, the coefficient KP, the I term, the delay time value TDL1, and the delay time value TDR1 are read from respective maps for steady operation, at the step S253, followed by terminating the routine.

[Calculation of proportional terms PR and PL, based on downstream O2 sensor]

Next, description will be made of a routine for calculating the PR and PL terms, which is executed during the air-fuel ratio feedback control based on the downstream O2 sensor 14R (hereinafter referred to as "the secondary O2 F/B control"). The routine for calculating the PR and PL terms is executed if execution of the secondary O2 F/B control routine is not inhibited or interrupted during failure of the downstream O2 sensor 14R, during open-loop control of the air-fuel ratio of the engine, during interruption of fuel supply, during idling of the engine, during a transient state of the downstream O2 sensor 14R, etc.

Figure 5A:
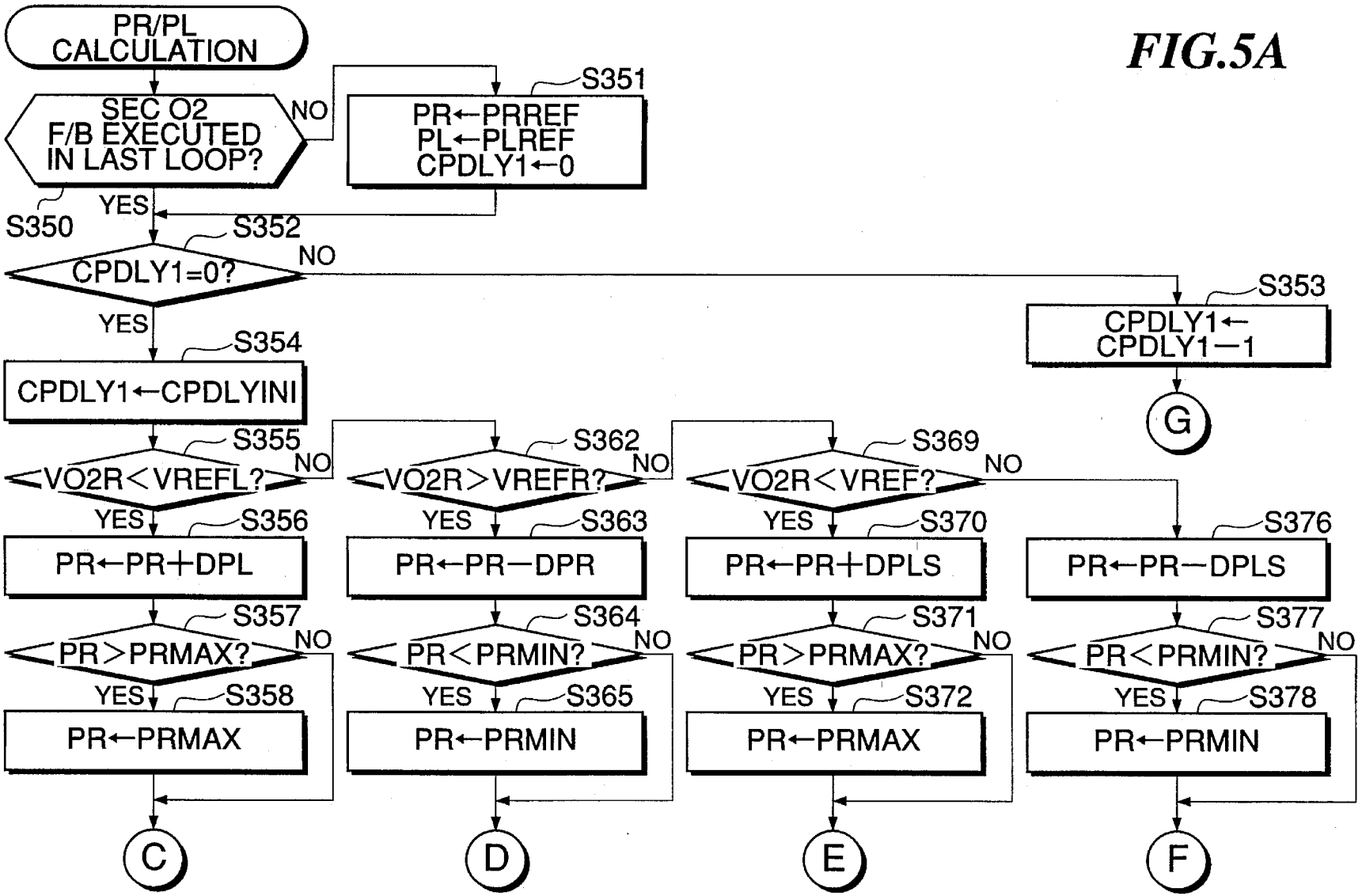
FIG. 5A is a flowchart showing a program for calculating proportional terms PL and PR.
Figure 5B:
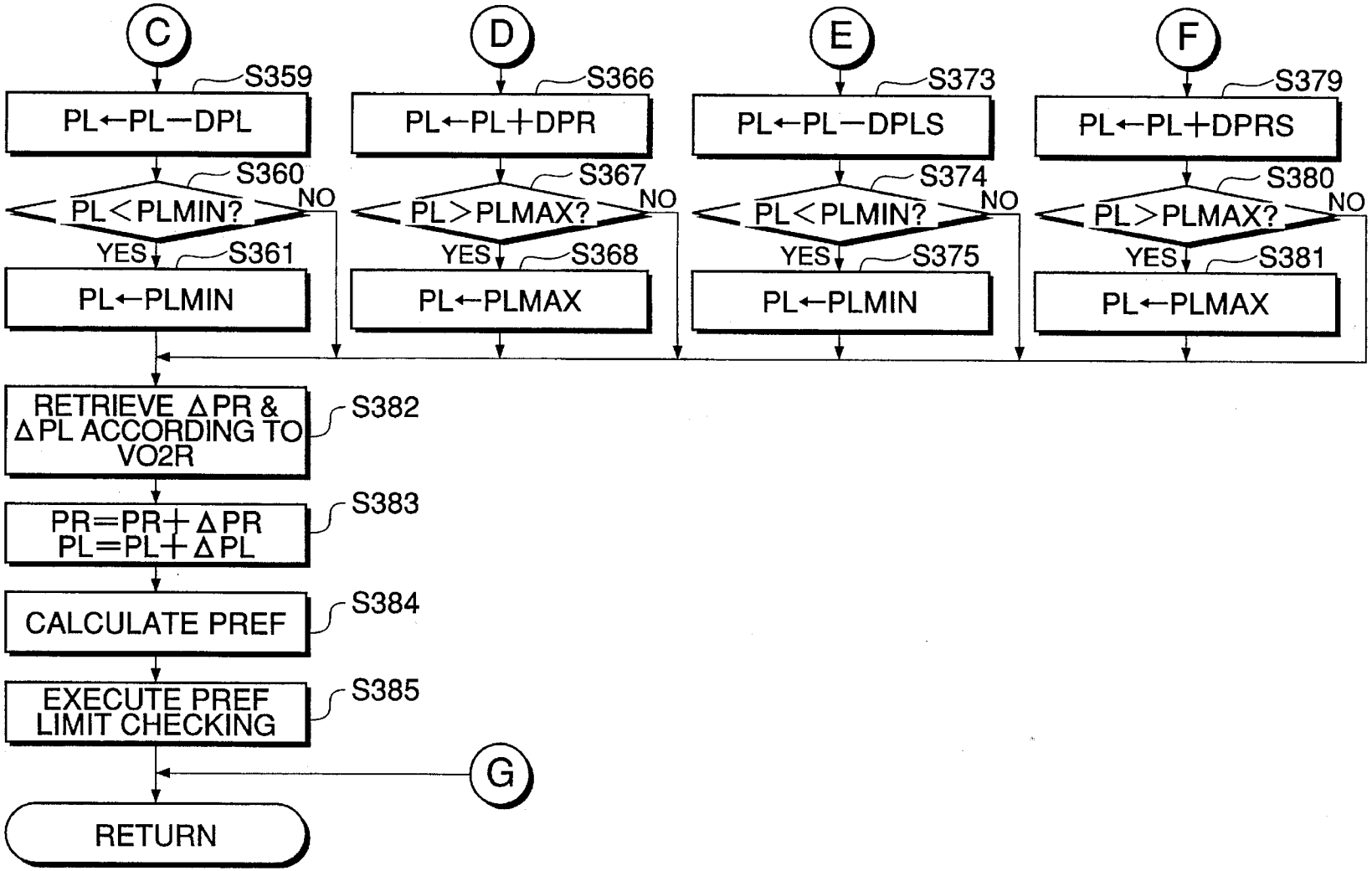
FIG. 5B is a continued part of the FIG. 4A flowchart.

FIGS. 5A and 5B show a program for calculating the proportional terms PL and PR. According to the program, the proportional terms PL and PR are calculated based on variation in the output VO2R from the downstream O2 sensor 14R. First, at a step S350, it is determined whether or not the engine was under the secondary O2 F/B control in the immediately preceding loop. If the engine was under the secondary O2 F/B control, the program proceeds to a step S352. On the other hand, if it was not under the secondary O2 F/B, the program proceeds to a step S351, wherein the PL term is set to an average value PLREF thereof and the PR term to an average value PRREF thereof, respectively, and a count value CPDLY1 of a counter CPDLY for measuring a delay time in calculating the proportional term (set value CPDLY1) is set to "0".

Then, it is determined at a step S352 whether or not the count value CPDLY1 of the counter CPDLY is equal to "0". If the answer is negative (NO), the program proceeds to a step S353, wherein the count value CPDLY1 is decremented by a value of 1, followed by terminating the program. On the other hand, if the answer to the question of the step S352 is affirmative (YES), the program proceeds to a step S354, wherein the count value CPDLY1 is reset to an initial value CPDLYINI thereof.

At the following step S355, it is determined whether or not the output VO2R from the downstream O2 sensor 14R is lower than a lean-side reference value VREFL. If the answer is affirmative (YES), i.e. if VO2R<VREFL, the program proceeds to a step S356, wherein a predetermined value DPL is added to the immediately preceding value of the proportional term PR to set the resulting value to the present value of the proportional term PR. Then, at a step S357, it is determined whether or not the proportional term PR is larger than an upper limit value PRMAX.

If the answer is affirmative (YES), i.e. if PR>PRMAX, the upper limit value PRMAX is set to the present value of the proportional term PR at a step S358, followed by the program proceeding to a step S359. On the other hand, if the answer to the question of the step S357 is negative (NO), i.e. if PR≦PRMAX, the program skips over the step S358 to the step S359.

At the step S359, the predetermined value DPL is subtracted from the immediately preceding value of the proportional term PL to set the resulting value to the present value of the proportional term PL, and then at a step S360, it is determined whether or not the present value of the proportional term PL is smallest than a lower limit value PLMIN. If the answer is affirmative (YES), i.e. if PL<PLMIN, the lower limit value PLMIN is set to the proportional term PL at a step S361, followed by the program proceeding to a step S382, wherein a ΔPR/ΔPL calculation (described hereinafter) is carried out. If the answer to the question of the step S360 is negative (NO), i.e. if PL≧PLMIN, the program skips over the step S361 to the step S382 to carry out the ΔPR /ΔPL calculation.

On the other hand, if the answer to the question of the step S355 is negative (NO) (VO2R≧VREFR), it is determined at a step S362 whether or not the output VO2R is higher than a rich-side reference value VREFR. If the answer is affirmative (YES), if VO2R>VREFR, the program proceeds to a step S363, wherein a predetermined value DPR is subtracted from the immediately preceding value of the proportional term PR to set the resulting value to the present value thereof. Then, at a step S364, it is determined whether or not the resulting proportional term PR is smaller than a lower limit value PRMIN of the proportional term PR.

If the answer to the question of the step S364 is affirmative (YES), i.e. if PR<PRMIN, the lower limit value PRMIN is set to the present value of the proportional term PR at a step S365, and then the program proceeds to a step S366. On the other hand, if the answer to the question of the step S364 is negative (NO), i.e. if PR≧PRMIN, the program skips over the step S365 to the step S366.

At the step S366, the value DPR is added to the immediately preceding value of the proportional term PL to set the resulting value to the present value of the proportional term PL. Then, it is determined at a step S367 whether or not the resulting proportional term PL is larger than an upper limit value PLMAX thereof. If the answer is affirmative (YES), i.e. if PL>PLMAX, the upper limit value PLMAX is set to the present value of the proportional term PL, followed by the program proceeding to the step S382 to carry out the ΔPR /ΔPL calculation, referred to hereinbelow. On the other hand, if the answer to the question of the step S367 is negative (NO), i.e. if PL≦PLMAX, the program skips over the step S368 to the step S382 to carry out the ΔPR /ΔPL calculation.

On the other hand, if the answer to the question of the step S362 is negative (NO), i.e. if VO2R≦VREFR, it is determined at a step S369 whether or not the output VO2R from the downstream O2 sensor 14R is lower than a reference value VREF therefor. If the answer is affirmative (YES), i.e. if VO2R<VREF, the program proceeds to a step S370, wherein a predetermined value DPLS (>DPL, DPR) is added to the immediately preceding value of the proportional term PR to set the resulting value to the present value thereof. Further, at a step S371, it is determined whether or not the resulting proportional term PR is larger than the upper limit value PRMAX.

If the answer to the question of the step S371 is affirmative (YES), i.e. if PR>PRMAX, the upper limit value PRMAX is set to the present value of the proportional term PR at a step S372, and then the program proceeds to a step S373. On the other hand, if the answer to the question of the step S371 is negative (NO), i.e. if PR≦PRMAX, the program skips over the step S372 to the step S373.

At the step S373, the present value of the proportional term PL is calculated by subtracting the predetermined value DPLS from the immediately preceding value of the proportional term PL, and then it is determined at a step S374 whether or not the resulting proportional term PL is smaller than the lower limit value PLMIN. If the answer is affirmative (YES), i.e. if PL<PLMIN, the lower limit value PLMIN is set to the present value of the proportional term PL at a step S375, followed by the program proceeding to the step S382 to carry out the ΔPR/ΔPL calculation. On the other hand, if the answer to the question of the step S374 is negative (NO), i.e if PL≧PLMIN, the step S375 is skipped over to the step S382 to carry out the ΔPR/ΔPL calculation.

On the other hand, if the answer to the question of the step S369 is negative (NO), i.e. if VO2R≧VREFR, the program proceeds to a step S376, wherein the predetermined value DPLS is subtracted from the immediately preceding value of the proportional term PR to set the resulting value to the present value thereof. Further, at a step S377, it is determined whether or not the resulting proportional term PR is smaller than the lower limit value PRMIN. If the answer is affirmative (YES), i.e. if PR<PRMIN, the lower limit value PRMIN is set to the present value of the proportional term PR at a step S378, and then the program proceeds to a step S379. If the answer to the question of the step S377 is negative (NO), i.e. if PR≧PRMIN, the program skips over the step S378 to the step S379.

At the step S379, the present value of the proportional term PL is calculated by adding the predetermined value DPRS to the immediately preceding value of the proportional term PL to set the resulting value to the present value thereof, and then it is determined at a step S380 whether or not the resulting proportional term PL is larger than the upper limit value PLMAX. If the answer is affirmative (YES), i.e. if PL>PLMAX, the upper limit value PLMAX is set to the present value of the proportional term PL at a step S381, followed by the program proceeding to the step S382 to carry out the ΔPR/ΔPL calculation. If the answer to the question of the step S380 is negative (NO), i.e if PL≦PLMAX, the program skips over the step S381 to the step S382 to carry out the ΔPR/ΔPL calculation.

Figure 6A:
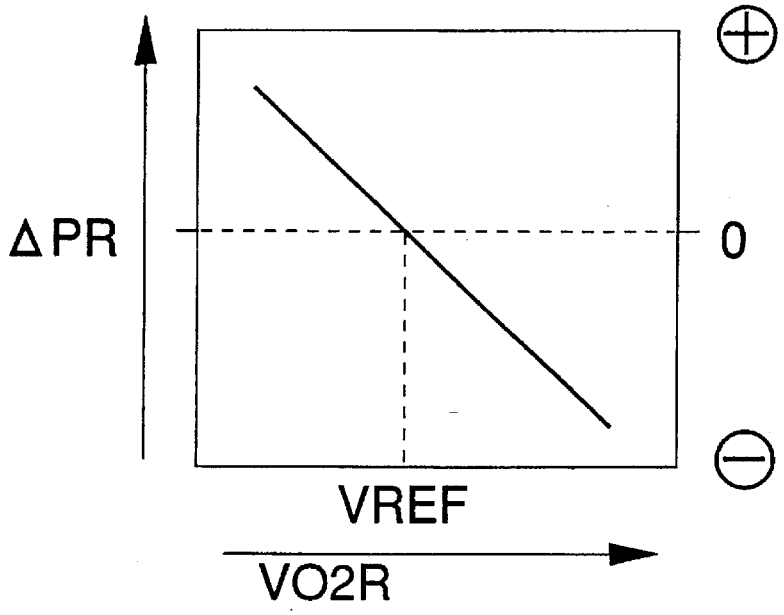
FIG. 6A shows a table showing the relationship between a rate of variation ΔPR and an output VO2R from a downstream O2 sensor 14R.
Figure 6B:
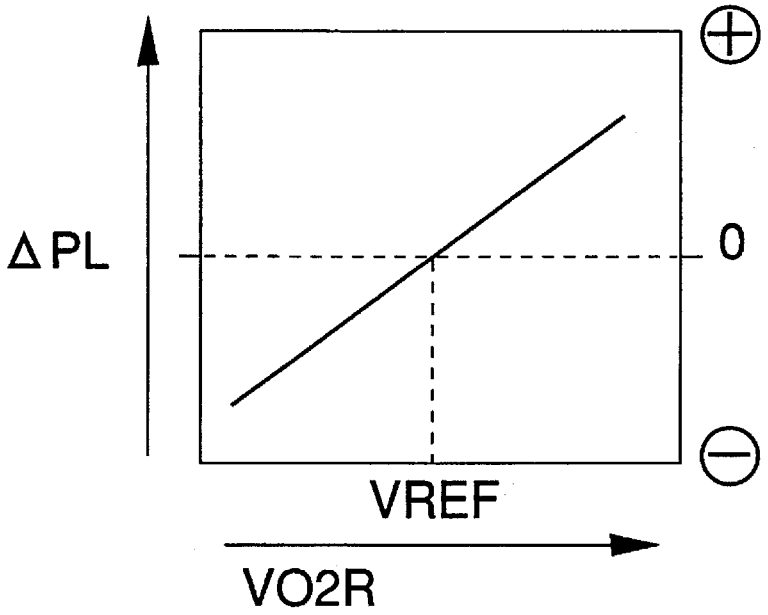
FIG. 6B shows a table showing the relationship between a rate of variation ΔPL and the output VO2R from the downstream O2 sensor 14R.

In execution of the ΔPR/ΔPL calculation, control variables ΔPR and ΔPL responsive to the output VO2R from the downstream O2 sensor 14R are added respectively to the PR and PL terms calculated in the above described manner. First, the control variables ΔPR and ΔPL are retrieved respectively from a control variable ΔPR table and a control variable ΔPL table, according to the output VO2R from the downstream O2 sensor 14R, at the step S382. FIG. 6A shows the relationship between the output VO2R from the downstream O2 sensor and the control variable ΔPR , and FIG. 6B shows the relationship between the output VO2R and the control variable ΔPL. Each of the control variables ΔPR and ΔPL is set in linear proportion to the output VO2R from the downstream O2 sensor 14R. Specifically, as the output VO2R from the downstream O2 sensor 14R increases toward the richer side, the control variable ΔPR is set to a smaller value, i.e. a larger value in the negative direction, whereas the control variable ΔPL is set to a larger value, i.e. a larger value in the positive direction.

Then, the thus retrieved control variables ΔPR and ΔPL are added respectively to the PR and PL terms calculated in the above described manner, at a step S383, to thereby obtain present values of the proportional terms PR and PL for the calculation of the air-fuel ratio correction coefficient KO2. After the addition of the control variables ΔPR and ΔPL, a PREF calculation is executed at a step S384. The PREF calculation is provided to obtain the average values PRREF and PLREF of the PR and PL terms, based on the PR and PL terms calculated at the step S383, respectively. If the PRREF and/or PLREF value falls outside a range between predetermined upper and lower limit values, the PRREF and/or PLREF value is set to the predetermined upper or lower limit value at a step S385, followed by terminating the present routine.

Thus, according to the present embodiment, integral control is executed such that if the relationship of VREFL≦VO2R≦VREFR is satisfied, the proportional terms PR, PL are incremented or decremented by smaller values, whereas if the output VO2R from the downstream O2 sensor 14R falls outside the above range between VREFL and VREFR, the proportional terms PR, PL are incremented or decremented by a larger value, and the proportional terms PR, PL thus calculated are limit-checked by setting them to the lower and upper limit values. Further, the control variables ΔPR and ΔPL determined according to the output from the downstream O2 sensor 14R are added to the thus calculated PR and PL terms. If the value of the PR term calculated by steps from the step S350 to the step S381 is equal to the lower limit value PRMIN or upper limit value PRMAX, and/or the value of the PL term calculated by steps from the step S350 to the step S381 is equal to the lower limit value PLMIN or upper limit value PLMAX, the control variable ΔPR and/or ΔPL may be set to "0".

Figure 7:
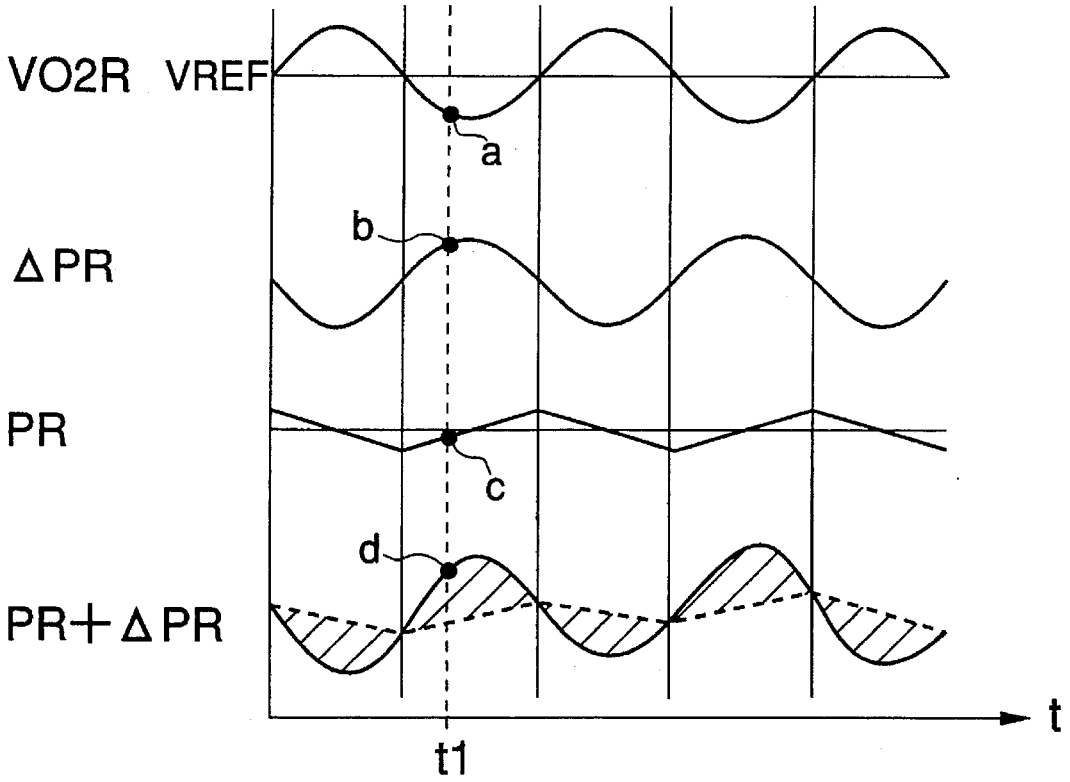
FIG. 7 is a timing chart showing the relationship in timing between the downstream O2 sensor output VO2R, the rate of variation ΔPR , a PR term obtained by integral control, and a sum of the PR term and the rate of variation ΔPR.

As described above, according to the present embodiment, during calculation of the PR and PL terms of the air-fuel ratio correction coefficient KO2, the control variables ΔPR and ΔPL are added to the PR and PL terms, respectively. As a result, air-fuel ratio control can be achieved, which quickly responds to the output VO2R from the downstream O2 sensor 14R. FIG. 7 shows the relationship in timing between the output VO2R, the control variable ΔPR , the PR term obtained by integral control, and a sum of the PR term and the ΔPR value calculated according to the invention. At a time point t1 indicated by the broken line, the output VO2R from the downstream O2 sensor 14R indicates a lean value (point a). Therefore, to bring the air-fuel ratio closer to the stoichiometric value, the value of the enriching proportional term PR for the calculation of the air-fuel ratio correction coefficient KO2 to be assumed at the time point t1 has to be increased to enrich the air-fuel ratio. At the time point t1, however, the PR term obtained only by integral control indicates a small value (point c), which cannot enable the air-fuel ratio control to quickly respond to the output from the downstream O2 sensor 14R. In contrast, the control variable ΔPR retrieved from the control variable ΔPR table assumes a large value (point b) in response to the output VO2R at the time point t1 (see FIG. 6A), and accordingly the value of the PR term (=PR+ΔPR ) set to the sum of the value of the PR term obtained only by integral control and the ΔPR value assumes a large value (point d). Thus, addition of the ΔPR value to the PR term makes the present value of the PR term sufficiently large, leading to enrichment of the average value of the air-fuel ratio of the mixture to be supplied to the engine and hence quick response of the air-fuel ratio to a lean value of the output VO2R from the downstream O2 sensor 14R. Similar results can be obtained by adding the control variable ΔPL to the PL term obtained only by integral control.

By virtue of the use of the control variables ΔPR, ΔPL, overriching and over-leaning of the air-fuel ratio of the mixture supplied to the engine can be avoided to thereby prevent degraded exhaust emission characteristics of the engine.

What is claimed is:

1. An air-fuel ratio control system for an internal combustion engine having an exhaust system, and a catalytic converter arranged in said exhaust system, for purifying noxious components in exhaust gases emitted from said engine, comprising:

upstream air-fuel ratio-detecting means arranged in said exhaust system at a location upstream of said catalytic converter, for detecting concentration of a specific component of said exhaust gases;

downstream air-fuel ratio-detecting means arranged in said exhaust system at a location downstream of said catalytic converter, for detecting concentration of said specific component of said exhaust gases;

control variable-setting means for setting a control variable having a value proportional to a difference between an output from Said downstream air-fuel ratio-detecting means and a first predetermined reference value;

air-fuel ratio correction value-calculating means for comparing between an output from said upstream air-fuel ratio-detecting means and a second predetermined reference value, and calculating an air-fuel ratio correction value, based on results of said comparison and said control variable set by said control variable-setting means; and air-fuel ratio control means for controlling an air-fuel ratio of an air-fuel mixture supplied to said engine, based on said air-fuel ratio correction value calculated by said air-fuel ratio correction value-calculating means.

2. An air-fuel ratio control system as claimed in claim 1, wherein said control variable determines a proportional term which is added to or subtracted from said air-fuel ratio correction value in response to an inversion of said output from said upstream air-fuel ratio-detecting means with respect to said second predetermined reference value.

3. An air-fuel ratio control system as claimed in claim 1, wherein said control variable-setting means sets said control variable such that said air-fuel ratio correction value is changed by a larger value as said difference between said output from said downstream air-fuel ratio-detecting means and said first predetermined reference value is larger.

4. An air-fuel ratio control system as claimed in claim 2, wherein said control variable is added to or subtracted from said proportional term.

5. An air-fuel ratio control system as claimed in claim 2, wherein said proportional term is determined based on interal control responsive to said output from said downstream air-fuel ratio-detecting means.

6. An air-fuel ratio control system for an internal combustion engine having an exhaust system, and a catalytic converter arranged in said exhaust system, for purifying noxious components in exhaust gases emitted from said engine, comprising:

upstream air-fuel ratio-detecting means arranged in said exhaust system at a location upstream of said catalytic converter, for detecting concentration of a specific component of said exhaust gases;

downstream air-fuel ratio-detecting means arranged in said exhaust system at a location downstream of said catalytic converter, for detecting concentration of said specific component of said exhaust gases;

control variable-setting means for setting a first control variable and a second control variable having values both proportional to a difference between an output from said downstream air-fuel ratio-detecting means and a first predetermined reference value;

air-fuel ratio correction value-calculating means for comparing between an output from said upstream air-fuel ratio-detecting means and a second predetermined reference value, and calculating an air-fuel ratio correction value, based on results of said comparison and said first and second control variables set by said control variable-setting means; and air-fuel ratio control means for controlling an air-fuel ratio of an air-fuel mixture supplied to said engine, based on said air-fuel ratio correction value calculated by said air-fuel ratio correction value-calculating means;

wherein said first control variable determines a first proportional term which is added to said air-fuel ratio correction value in response to an inversion of said output from said upstream air-fuel ratio-detecting means from a rich side to a lean side with respect to said second predetermined reference value, and said second control variable determines a second proportional term which is subtracted from said air-fuel ratio correction value in response to said inversion of said output from said upstream air-fuel ratio-detecting means from said lean side to said rich side with respect to said second predetermined reference value.

7. An air-fuel ratio control system as claimed in claim 6, wherein said control variable-setting means sets said first and second control variables such that said air-fuel ratio correction value is changed by a larger value as said difference between said output from said downstream air-fuel ratio-detecting means and said second predetermined reference value is larger.

8. An air-fuel ratio control system as claimed in claim 6, wherein said first and second proportional terms are determined based on integral control responsive to said output from said downstream air-fuel ratio-detecting means.

* * * * *